United States Patent [19]

Tomio

[11] 4,067,364

[45] Jan. 10, 1978

[54] APPARATUS FOR REVERSING AND RACING A CARD IN A DOBBY MACHINE

[75] Inventor: Nishikayama Tomio, Nagoya, Japan

[73] Assignee: Yamada Dobby Co., Ltd., Nagoya, Japan

[21] Appl. No.: 644,147

[22] Filed: Dec. 24, 1975

[30] Foreign Application Priority Data

Dec. 28, 1974 Japan ..... 50-2239

[51] Int. Cl.[2] ..... D03D 51/00

[52] U.S. Cl. ..... 139/324; 139/329; 139/1 E; 74/397

[58] Field of Search ..... 139/1 E, 324, 328, 329; 74/397, 781 R, 785

[56] References Cited

U.S. PATENT DOCUMENTS

| | | | |
|---|---|---|---|
| 1,843,506 | 2/1932 | Deconing | 139/329 |
| 2,633,755 | 4/1953 | Bomnelaer | 74/397 |
| 2,753,894 | 7/1956 | Lovshin et al. | 139/1 E |
| 3,318,341 | 5/1967 | Nollet | 139/1 E |
| 3,413,920 | 12/1968 | Kaneko et al. | 74/397 |
| 3,831,637 | 8/1974 | Juillard et al. | 139/1 E |
| 3,895,653 | 7/1975 | Koyama | 139/324 |

*Primary Examiner*—Henry S. Jaudon
*Attorney, Agent, or Firm*—Frank J. Jordan

[57] ABSTRACT

An apparatus for reversing and racing a card in a dobby machine by using a planetary gear mechanism for reversing a card cylinder by a specified angle and operating a card handle fixed on the shaft, thus avoiding damage to the machinery even when operational errors occur.

12 Claims, 8 Drawing Figures

APPARATUS FOR REVERSING AND RACING A CARD IN A DOBBY MACHINE

BACKGROUND OF THE INVENTION

1. Field of the Invention

The pin clutch mechanism for reversing and racing the card in a dobby machine is replaced with a planetary gear mechanism, thereby facilitating and ensuring easy operation for reversing and racing the card.

2. Description of the Prior Art

Hitherto, in the case of weaving by using a dobby machine, for example, when removing several lines of warps due to operational errors, there has been reversing apparatuses reversely operating only opening movement of the dobby machine after stopping the loom. These apparatuses can make reversely opening movement in proper order by moving the card half a pitch. However, these reversing apparatuses have been complicated in construction and functionally insufficient.

In the case of racing the card, the card cylinder has been raced by manual operation and there have been disadvantages greatly decreasing working capacity, rousing difficulties in operation. To overcome these disadvantages, applicant previously developed a pin clutch type apparatus for reversing and racing the card as disclosed in U.S. Pat. No. 3,895,653 issued July 22, 1975.

However, the apparatus of the aforementioned U.S. Pat. No. 3,895,653 for moving forward and backward and racing the card is of the pin clutch type, so that the operation of connecting and disconnecting between the clutch pin and clutch sleeve tends to be unreliable and there has been a danger of damage to the machinery, particularly to the parts concerned with the due to operational errors of the lever.

SUMMARY OF THE INVENTION

In an attempt to effect normal drawing out and easy racing operation in a dobby machine an apparatus for reversing a card by moving a specified length between cards is obtained by providing a planetary gear mechanism rotating the cylinder shaft in a specified direction and drawing out the delaying timing and racing the shaft by pulling the card handle, thereby offering an apparatus for reversing and racing the card, which facilitates and ensures simple operation avoiding damage to the machinery even when operational errors occur.

OBJECTS OF THE INVENTION

An object of this invention is to facilitate reliable and simple drawing out operation of warps by operating a handle of a planetary gear mechanism.

Another object of this invention is to realize free racing of a card cylinder by operating a card handle connected to a shaft.

Yet another object of this invention is to facilitate operation for reversing and racing a card, thereby avoiding damage to machinery even when operational errors occur.

A further object of this invention is to facilitate push-button operation and connection with oil/air pressure and a solenoid which is readily effected with lesser wear by employing a planetary gear mechanism.

Still further objects and features will be discussed in detail with reference to the annexed drawings.

BRIEF DESCRIPTION OF THE DRAWINGS

Drawings illustrate embodiment of this invention.

DETAILED DESCRIPTION OF PREFERRED EMBODIMENTS

Figure 1:
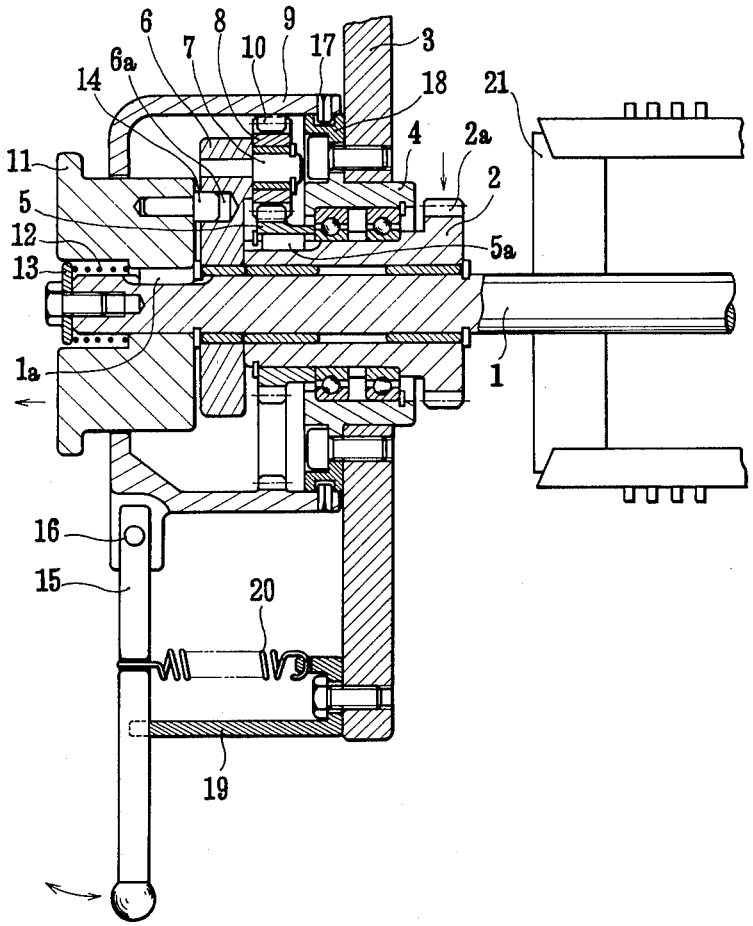
FIG. 1 is a sectional view, of one embodiment of the present invention
Figure 2:
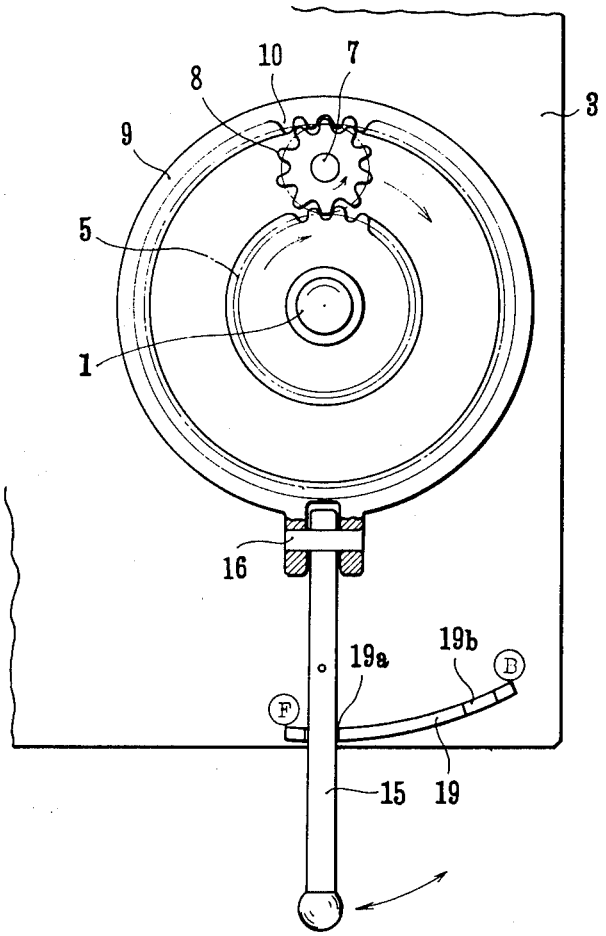
FIG. 2 is an operational view of a planetary gear mechanism in normal operation.
Figure 3:
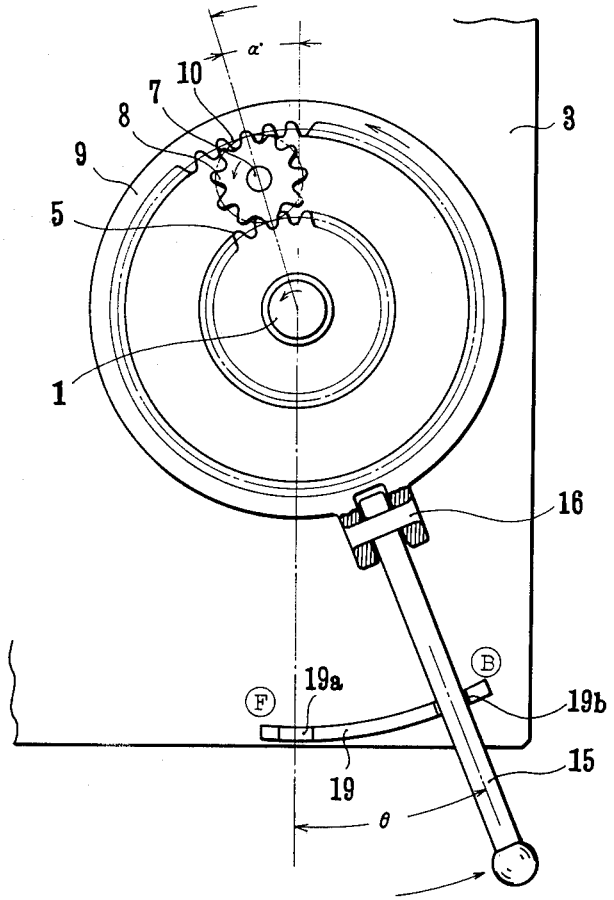
FIG. 3 is an operational view of a planetary gear mechanism when turning a handle at a reversing position.

As shown in FIG. 1 to 3 of the first embodiment, a gear 2 is rotatably mounted on a cylinder shaft 1. The first gear 2 has toothed means **2*a* in its outer circumferential edge and its outer circumferential and longitudinal center is disposed in a bearing 4 mounted on chassis 3. A second gear 5 is fixedly mounted in axially spaced relation to the toothed means 2*a* of gear 2 on the longitudinally extending hollow shaft portion thereof through a key 5*a***.

A disc 6 is rotatably mounted on the cylinder shaft 1 adjoining gear 2 and a pin 7 is fixed on disc 6. A planetary gear 8 is rotatably mounted on the pin 7.

The planetary gear 8 is part of a planetary gear mechanism having teeth engaging the gear 5 and a circumferentially extending internal or female gear 10 cut inside a housing 9. A card handle 11 reciprocating on a key **1*a* disposed in the cylinder shaft 1 is mounted on the cylinder shaft 1 through a spring 12 by means of a stopper 13, whereby a pin 14 is connected and the head means of the pin 14 is removably insertable in a hole 6*a* drilled in the disc 6**.

On the lower part of housing 9, a handle 15 is movably attached thereto to be inclined in the axial direction of cylinder shaft 1 through a pivot 16. In the vicinity of chassis 3 a pin 17 is inwardly embedded in housing 9 and disposed in a pin receiving means 18 fixed on chassis 3 so that the housing 9 itself can turn slidingly on pin receiving means 18.

The handle 15 is movable in three directions relative to the chassis by spring 20 so as to slide along the positioning bracket fixed on the chassis 3. On the positioning bracket 19, concave means **19*a* and 19*b* securing forward and backward positions are formed. A card the cylinder 21 is attached to cylinder shaft 1**.

Now the operation of the invention will be discussed.

Gear 2 rotates on cylinder shaft 1 and is driven from a main shaft by an intermediate gear not shown in drawings. On a boss of gear 2, the gear 5 is fixedly mounted by key **5*a* and rotates planetary gear 8. Planetary gear 8 which forms part of a planetary gear mechanism engages gear 5 along one side of its geer teeth and female gear 10 cut in housing 9** along its other side of gear teeth.

Since housing 9 is restricted to rotate by positioning bracket 19 through handle 15, the rotation of planetary gear 8 rotates disc 6 and card handle 11 connected to disc 6 by pin 14. Card handle 11 reciprocates in the axial direction with respect to shaft 1, but in the radial direction it is connected by the key, so that the rotation of card handle 11 is transmitted to cylinder shaft 1.

The drawing out function (phase function) is illustrated in FIGS. 2 and 3.

If forward rotation of the card is in a clockwise direction cylinder shaft 1 also rotates forward in a clockwise direction as shown by the arrow in FIG. 2.

In this case, handle 15 of housing 9 maintains the timing of the card, being positioned in the concave means 19*a* of positioning bracket 19.

When the operating phase includes reversing the rotation of the dobby, i.e., when timing the card half a pich, $\alpha$ degrees, reversed, by moving handle 15 of housing 9 into the concave means 19*b* opposite to the position of positioning bracket 19, in other words, by moving handle 15 counterclockwise by $\theta$ degree, cylinder shaft 1 can be delayed by rotating in a backward direction by half a pich, $\alpha$ degrees, by means of the planetary gear mechanism.

Card racing function.

Sliding card handle 11 in the axial direction of the shaft against the bias of spring 12 and drawing pin 14 out of disc 6 releases the connection between card handle 11 and disc 6, and rotating card handle 11 under this condition results only in rotating cylinder shaft 1.

The mechanism carrying out the previously described drawing out function (phase function) facilitates push-button operation and interlocking with the pick finder handle, being combined with either oil or air pressure or a solenoid.

For instance, the case of interlocking with the pick finder by using a solenoid, SOL will be discribed.

Figure 4:
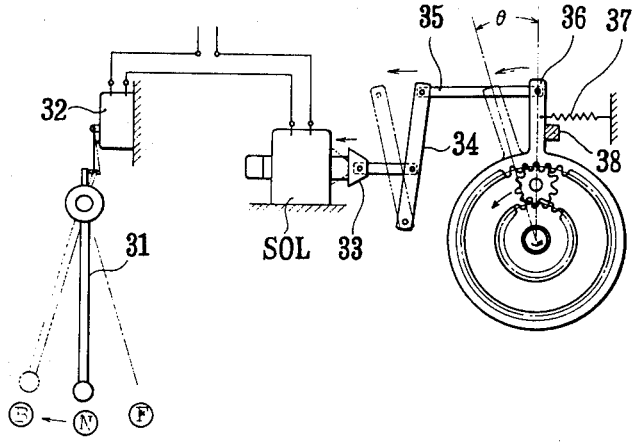
FIG. 4 is a schematic view of a planetary gear mechanism interlocked with a pick finder by using a solenoid.

Referring to FIG. 4 in the case where handle 31 of the pick finder is in its "N" or "forward" position, limit switch 32 is in an off condition, solenoid SOL does not operate, and plunger 33 is in a projecting position, so that lever 36 of phase housing is held in a "forward" position being in contact with stopper 38 by means of spring 37.

In the case of reversing the dobby machine with the pick finder, putting handle 31 of the pick finder in its "backward" position, limit switch 32 goes on, solenoid SOL activated, phunger 33 drawn in and positioned after hitting the solenoid case, lever 36 of the housing turned by $\theta$ degree (half a pich of the card), whereby timing of the card is thereby delayed.

Figure 5:
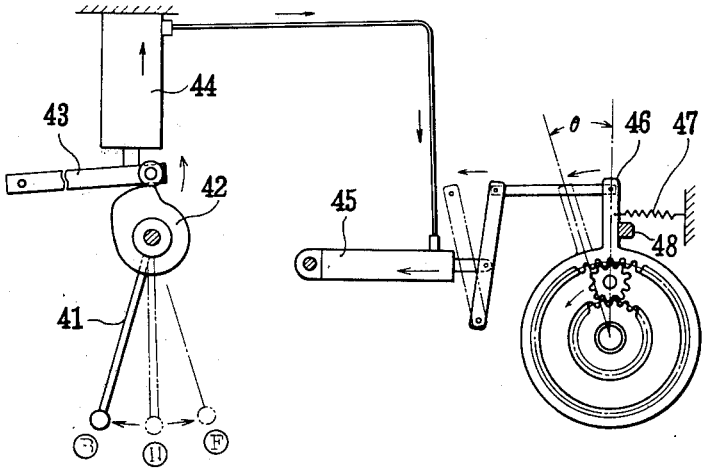
FIG. 5 is a schematic view of a planetary gear mechanism interlocked with a pick finder by using oil pressure.

FIG. 5 shows the case where drawing out is operated by oil pressure whereby when handle 41 of the pick finder is in either its "N" or backward positions, the protuberance of cam 42 presses cam arm 43 and causes oil pressure pump 44 to operate and to feed oil pressure cylinder 45 which rotates lever 46 of the housing by $\theta$ degree (half a pich of card), whereby timing of the card is thereby delayed.

When handle 41 is in its "forward" position, cam 42 does not press cam arm 43 so that lever 46 of the housing keeps lever 46 in its "forward" position, being pulled by spring 47 and in contact with stopper 48.

A second embodiment of a planetary a first gear mechanism will be described with reference to FIG. 6.

Figure 6:
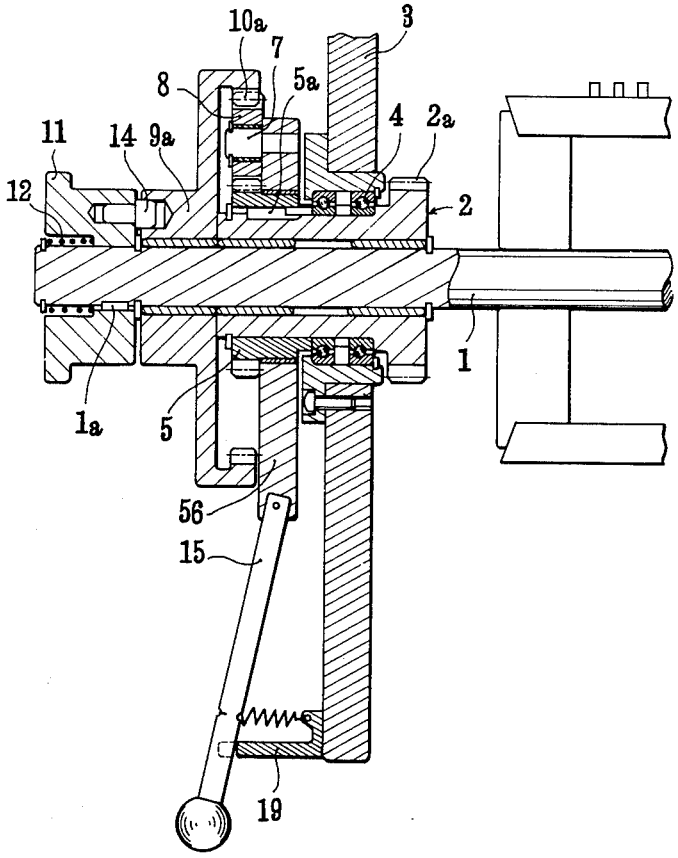
FIG. 6 is a sectional view of an embodiment being a planetary gear mechanism.

Referring to FIG. 6, gear 2 is rotatably mounted on cylinder shaft 1, and is arranged with toothed means 2*a* on its outer circumferential edge while the outer circumferential and longitudinal center is disposed in bearing 4 mounted on chassis 3. On the opposite side of toothed means 2*a* of gear 2 a second gear 5 is fixedly mounted in axially spaced relation thereto on the longitudinally extending hollow shaft portion of such gear through key 5*a*. On the outer circumference of gear 5 on an axial extension thereof and by the side of chassis 3, disc 56 is mounted and planetary gear 8 is rotatably mounted around pin 7 fixed on the disc 56.

And similary to the first embodiment a planetary gear mechanism comprises a planetary gear 8, with its toothed means, emgaging the, gear 5 and circumferentially extending internal or female gear 10*a* of the toothed disc 9*a*, female gear 10*a* being cut in the inner circumference of toothed disc 9*a* and being rotatably mounted on cylinder shaft 1. By the side of toothed disc 9*a*, card handle 11 reciprocating along key 1*a* disposed in cylinder shaft 1 is arranged at one end of cylinder shaft 1 through spring 12 and pin 14 embedded in card handle 11 is removably insertable in a pin hole of toothed disc 9*a*. At the lower part of the disc 56, handle 15 is pivoted, which construction provides for securing the forward and backward positions sliding along bracket 19 as in the first embodiment.

The operation of the above second embodiment will be discribed. Gear 2 rotatably mounted on cylinder shaft 1 is driven by a main shaft through an intermediate gear not shown in the drawings, and rotates gear 5. The rotation of gear 5 is transmitted to planetary gear 8 which is rotatably attached to pin 7 fixed in disc 56. Therefore, handle 15 being secured in its "forward" or "backward" position by being disposed in the concave means of the positioning bracket 19, the rotation of planetary gear 8 rotates toothed disc 9*a* engaging female gear 10*a* cut inside toothed disc 9*a*. The rotation of toothed disc 9*a* turns the card transmitted from card handle 11 to cylinder shaft 1 through pin 14 embedded in card handle 11.

In the operating phase, handle 15 is placed in a specified concave means of positioning bracket 19 by changing the position of disc 56, thereby timing can be delayed as previously described.

This invention replaces the pin clutch apparatus for reversing and racing the card with a planetary gear mechanism, in which the drawing out operation takes place delaying timing by rotating the cylinder shaft in the specified directions and the shaft is raced by pulling the card handle, so that the operation is easy and reliable thereby avoiding damage to the machinery even when operational errors occur. The construction is simple and there is no danger of damaging the dobby and related apparatus even if the operation handle is mishandled by accident during the operation. Especially, by means of a planetary gear mechanism, abrasion is small and providing a connection between an oil or air pressure cylinder and solenoid is simple, so that it facilitates push-button operation. Moreover, phase operation takes place automatically with the operation of the pick finder alone by inter-locking with the lever of the pick finder.

We claim:

1. An apparatus for reversing and racing a card cylinder in a dobby machine comprising a shaft adapted to be drivingly connected to the card cylinder; a first gear rotatably mounted on said shaft; a second gear secured to and axially spaced from said first gear; an annular housing positioned about said shaft having an internal gear extending circumferentailly therewithin; a planetary gear means including a disc element rotatably mounted about said shaft, a pin carried by said disc element adjacent the periphery thereof, and a planetary gear mounted on said pin and rotatable relative to said disc element; a card handle mounted on said shaft at the longitudinal end thereof remote from the operative connection of said shaft with the card cylinder to be axially movable therealong the thereby selectively rotatable therewith; and an operating handle connected operatively to said planetary gear and operable to be rotated to thereby effect reversing of the card cylinder.

2. An apparatus for reversing and racing a card cylinder in a dobby machine comprising a shaft adapted to be drivingly connected to the card cylinder; a first gear rotatably mounted on said shaft; a second gear secured to and axially spaced from said first gear; an annular housing disposed about said shaft having a circumferentially extending internal gear; a planetary gear means comprising a disc element rotatably carried by said second gear and a planetary gear rotatably carried by said disc element adjacent the periphery thereof and operatively disposed between said internal gear and said second gear; a card handle mounted on one longitudinal end of said shaft axially movable thereon for selective operative engagement or disengagement with said housing; and an operating handle connected to said disc element and operable to be rotated to rotate said disc element; whereby racing and reversing of said card cylinder is effected by operation respectively of said card handle and said operating handle.

3. An apparatus according to claim 2 wherein said disc element is mounted rotatably on an axial extension of said second gear.

4. An apparatus according to claim 2 wherein said annular housing is rotatably mounted on said shaft.

5. An apparatus according to claim 2 wherein said card handle is provided with at least one axial pin and said housing is provided with at least one axial opening therein dimensioned to receive corresponding ones of said pins, spring means being provided for normally biasing said card handle into operative engagement with said housing through insertion of said pins into said openings so as to make card handle and housing rotatable together.

6. An apparatus for reversing and racing a card cylinder in a dobby machine comprising a shaft adapted to be connected to the card cylinder; a first gear rotatably mounted on said shaft; a second gear secured to and axially spaced from said first gear; an annular housing disposed about said shaft; said housing having a circumferentially extending internal gear; a planetary gear means comprising a disc element rotatably mounted on said shaft and a planetary gear rotatably carried by said disc element adjacent the periphery thereof and operatively disposed between said internal gear and said second gear; a card handle mounted on one longitudinal end of said shaft axially movable thereon for selective operative engagement or disengagement with said disc element; and an operating handle connected to said housing and operable to be rotated to rotate said housing; whereby racing and reversing of said card cylinder is effected by operation respectively of said card handle and said operating handle.

7. An apparatus according to claim 6 wherein said first gear is adapted to be driven, a chassis part, and bearing means rotatingly supporting said first gear in said chassis part.

8. An apparatus according to claim 7 further comprising a spring disposed between said operating handle and said chassis part, said chassis part comprising a positioning bracket, said positioning bracket having engaging means, said operating handle being securable in said engaging means to secure a forward and a backward position for said operating handle, said operating handle being movable between said forward and backward positions by overcoming the bias of said spring.

9. An apparatus according to claim 6 wherein said first gear includes a longitudinally extending hollow shaft portion, and key means securing said second gear to said hollow shaft portion.

10. An apparatus according to claim 7 including means for rotatably mounting said housing on said chassis.

11. An apparatus according to claim 6 wherein key means are provided between said card handle and said shaft such that said card handle rotates with said shaft, and spring means are provided axially biasing said card handle to urge the latter into engagement with said disc element.

12. An apparatus according to claim 6 wherein said card handle is provided with a pin, said disc element having an opening for receiving said pin when said card handle is in engaged position therewith.

* * * * *